US006398700B1

(12) United States Patent
Ruuska et al.

(10) Patent No.: US 6,398,700 B1
(45) Date of Patent: Jun. 4, 2002

(54) ROLL FOR A PAPER/BOARD MACHINE OR FINISHING DEVICE AND METHOD FOR FASTENING AN INNER TUBE INTO THE INTERIOR OF THE SAME

(75) Inventors: Jukka Ruuska; Jouni Järvinen; Kari Kärkkäinen; Leo Honkanen, all of Jyväskylä; Harri Karttunen, Vihtavuori; Kari Viik, Vaajakoski; Jari Kallioinen, Vihtavuori; Juhani Raatikainen, Jyväskylä, all of (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/258,845

(22) Filed: Feb. 26, 1999

(30) Foreign Application Priority Data

Feb. 27, 1998 (FI) ..... 980457

(51) Int. Cl.[7] ..... F28F 5/02
(52) U.S. Cl. ..... 492/20; 162/206; 492/46
(58) Field of Search ..... 492/20, 46, 2, 492/5, 6, 7, 16; 162/206, 207, 375; 100/137, 138, 211; 92/12.1, 51, 52, 66, 72, 81, 82, 85 A, 85 B, 106, 176, 181 R, 193

(56) References Cited

U.S. PATENT DOCUMENTS 3,086,279 A * 4/1963 Alexeff ..... 492/6
3,389,448 A * 6/1968 Buysch ..... 492/6
5,103,542 A * 4/1992 Niskanen ..... 29/16.2
5,290,223 A * 3/1994 Lehmann ..... 492/7
5,509,883 A * 4/1996 Niskanen et al. ..... 492/20
5,566,451 A * 10/1996 Niskanen et al. ..... 29/895.3
5,685,813 A * 11/1997 Kivioja et al. ..... 492/7
5,702,337 A * 12/1997 Renn et al. ..... 492/7
5,860,903 A * 1/1999 Niskanen ..... 492/20
5,899,264 A * 5/1999 Marschke ..... 165/89
5,909,917 A * 6/1999 Kivioja et al. ..... 29/895.2
5,967,957 A * 10/1999 Kusters ..... 492/7
5,967,958 A * 10/1999 Borkenhagen et al. ..... 492/46
6,017,422 A * 1/2000 Brox ..... 162/358.3

* cited by examiner

*Primary Examiner*—I Cuda Rosenbaum
*Assistant Examiner*—M. Butler
(74) *Attorney, Agent, or Firm*—Steinberg & Raskin, P.C.

(57) ABSTRACT

Roll for a paper/board machine or finishing device having an interior in which an inner tube is installed and a method for fastening the inner tube in the roll interior. The inner tube is arranged so that its outer face is spaced from the inner face of the mantle of the roll whereby a heat transfer medium can be passed into the interior of the roll and through this space in an axial direction of the roll. The inner tube includes fastenings arranged at one or more axial locations. At each axial location, at least one fastening can be positioned radially in a certain predetermined position and another fastening can be displaced freely in the radial direction.

14 Claims, 2 Drawing Sheets

ROLL FOR A PAPER/BOARD MACHINE OR FINISHING DEVICE AND METHOD FOR FASTENING AN INNER TUBE INTO THE INTERIOR OF THE SAME

FIELD OF THE INVENTION

The present invention relates to a roll for a paper/board machine or for a paper/board finishing device and a method for fastening an inner tube in the interior of a roll of a paper/board machine or a paper/board finishing device.

BACKGROUND OF THE INVENTION

Polymer-coated rolls arranged in calenders require cooling so that they will operate optimally. By means of such cooling, attempts are made to keep the end and lateral areas of the roll at a uniform temperature so that the effect of crown formation by the effect of heat is minimized.

For cooling, a so-called displacement tube technique has been applied.

The principle of the displacement tube technique is briefly as follows: water at the required temperature is passed to the end of the roll by means of a water coupling, water circulates in the interior of the roll along a space between an inner tube and an outer tube to the opposite end of the roll, and at the opposite end of the roll there is a water coupling through which the water is passed out of the roll. The space between the inner tube and the outer tube in the roll is usually quite small. In this manner, even though the amounts of water are quite small, attempts are made to keep the flow sufficiently large in order to meet the requirement of a uniform temperature in the end and lateral areas of the roll.

It has been laborious and difficult to fit the inner tube and the outer tube one inside the other. First, it has been necessary to measure and to manufacture the inner tube separately for each roll because the diameters of the outer tube vary from roll to roll. Then, in the installation stage, it has been necessary to cool the inner tube with nitrogen in order to fit the tube into the interior of the outer tube. Thus, manufacturing rolls with inner tubes has been typically a time-consuming and technically and economically unfavorable procedure.

OBJECTS AND SUMMARY OF THE INVENTION

It is an object of the present invention is to provide a solution for installing an inner tube in a roll by whose means the difficulties related to the prior art methods are overcome.

It is another object of the present invention to provide new and improved rolls for a paper/board machine or for a paper/board finishing device.

It is another object of the present invention to provide new and improved methods for fastening an inner tube in an interior of a roll, especially for use in a paper/board machine or paper/board finishing device.

It is yet another object of the present invention to provide an inner tube for a roll which is able to be arranged in the inside of rolls having different diameters so that the inner tube does not have to be roll-specific.

In order to attain these objects and others, in a roll in accordance with the present invention, the inner tube, by whose means the water is forced to flow along the inner face of the mantle of the roll body, is fastened to the body mantle by fastening pistons which are installed on the inner tube with a necessary spacing in the longitudinal direction whereby three pistons are arranged in the direction of the circumference. Of the pistons in the direction of the circumference, two are fixedly installed at a proper height in connection with the installation, and one is freely moving and spring-loaded. The spring-loaded piston is constructed so that, by means of hydraulics, the piston is pressed down for the time of installation of the inner tube. The pipe systems required by the hydraulics are passed along the outer face of the inner tube, preferably to the tending-side end of the roll. The pressure required by the hydraulics is produced by means of a normal hydraulic pump (the same pump by whose means the bearing is removed/fixed). After the inner tube has been installed in the correct position, the hydraulic pressure is released, and the disk springs of the spring-loaded piston press the piston against the body mantle. By means of the fixed and the spring-loaded pistons, the inner tube is kept in its position, and vibration and bending of the inner tube are prevented. The fastening at the ends is arranged either so that separate rings attached to the flange shafts by means of hexagonal socket-head bolts, on which rings the inner tube is installed with glide fitting, or, in new projects, so that alterations are made to the cast models of the flange shaft, and the end fastening face is provided directly on the flange shaft. In this manner, separate rings are not needed.

Thus, one general embodiment of a roll for a paper/board machine or finishing device comprises a roll mantle defining an interior and having an inner face, an inner tube arranged in the interior of the roll mantle and having an outer face arranged at a distance from the inner face of the roll mantle, and a plurality of fastening elements (or simply fastenings) for securing the inner tube to the roll mantle. At least one fixed fastening is positioned radially in a certain predetermined position (fixed in that it includes a piston which is not movable during the installation procedure) and a displaceable fastening is arranged to be displaceable in a radial direction of the inner tube (displaceable in that it includes a component which is movable during the installation procedure). The inner tube may comprise apertures at first and second ends and the roll further comprises first and second shafts arranged at first and second ends of the roll mantle. Each shaft includes a flow passage communicating with a space between the inner face of the roll mantle and the outer face of the inner tube via the apertures in the inner tube.

The displaceable fastening comprises a spindle part having a head part and biasing means, e.g., a spring unit of one or more springs, for urging the head part against the inner face of the roll mantle. It may also comprise an interior space receivable of pressure fluid defined adjacent the spindle part. The biasing means are thus arranged such that upon removal of pressure fluid from the interior space (which occurs after the inner tube is installed in the interior of the roll), the head part is urged against the inner face of the roll mantle. The displaceable fastening may also comprise a piston part, whereby the interior space is defined between the piston part and the spindle part, and a sleeve defining a first interior space and a second interior space having a diameter smaller than a diameter of the first interior space and having an edge portion in the vicinity of an inlet opening of the first interior space. The sleeve defines an inside shoulder between the first and second interior spaces. The spindle part may include a rod connected to the head part and surrounded by the spring(s) of the spring unit. An intermediate disk may be arranged on the shoulder and a cotter ring may be provided to lock the disk against the shoulder. The disk includes a central opening through which the rod of the spindle part passes. The piston part includes an inner bore having threading and the rod includes a threading in engagement with the threading of the piston part. Further, the fastening may include an end disk arranged at an end of the inner bore of the piston part, and a cotter coupled to the piston part for preventing rotation of the piston part. The cotter is guided in a hole in the sleeve of the fastening. In some embodiments, the sleeve includes a duct for allowing passage of pressure fluid into and from the interior space in the fastening.

There are preferably two fixed fastenings. Each fixed fastening comprises a sleeve and a screw arranged in the sleeve and having an outer face adapted to be pressed against the inner face of the roll mantle. The screw is rotatable relative to the sleeve to provide adjustable extension of the screw from the sleeve, which rotation is effected prior to installation or insertion of the inner tube into the interior of the roll mantle. The screw is then locked in its position and then the inner tube is inserted into the interior of the roll. In some embodiments, the screw has a spindle part having a threaded outer surface and a backup part wider than the spindle part. The interior of the sleeve defines a wide recess and an end bore having a threading. The spindle part of the screw threadingly engages with the threading of the end bore of the sleeve. The backup part includes a curved outer face adapted to be pressed against the inner face of the roll mantle upon rotation of the screw relative to the sleeve.

In the method for fastening an inner tube into an interior of a roll for a paper/board machine or finishing device, at least one first fastening is arranged in the inner tube at a location along an axis of the inner tube, each first fastening having an extension projectable above the outer face of the inner tube and designed to be fixed in position during installation of the inner tube into the interior of the roll. A second fastening is arranged in the inner tube at the same axial location as the first fastening(s), the second fastening having a displaceable spindle part movable between first and second position whereby the spindle part projects further above the outer face of the inner tube in the second position (although in the first position, the spindle part does not necessarily have to project above the outer face of the inner tube). The position of the extension of each first fastening is adjusted and preferably fixed at a desired radial projecting position prior to installation of the inner tube in the interior of the roll. The inner tube is then inserted into the mantle of the roll while maintaining the spindle part of the second fastening in the first position. The spindle part of the second fastening is then displaced into the second position and urged against the inner face of the mantle, e.g., by the decompression of springs in a spring unit.

The spindle part of the second fastening may be maintained in the first position by coupling a pipe to the second fastening, extending the pipe to one of the ends of the inner tube and directing a medium through the pipe to cause displacement of the spindle part of the second fastening to the first position such that control of the displacement of the spindle part of the second fastening is effected from the end of the inner tube. Similarly, the spindle part of the second fastening may be maintained in the first position and caused to be displaced into the second position by coupling a pipe to the second fastening, arranging a piston part and a stationary disk in the second fastening, arranging at least one spring between a head part of the spindle part and the disk, and controlling the flow of pressure fluid through the pipe into and from a space between the disk and the piston part. When the pressure fluid flows into the space, the spindle part is moved to the first position and the at least one spring is compressed, and when the pressure fluid flows from the space, the spindle part is moved to the second position upon decompression of the at least one spring.

In the following, the invention will be described in detail with reference to some exemplifying embodiments of the invention illustrated in the figures in the accompanying drawing. However, the invention is by no means strictly confined to the details of the illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
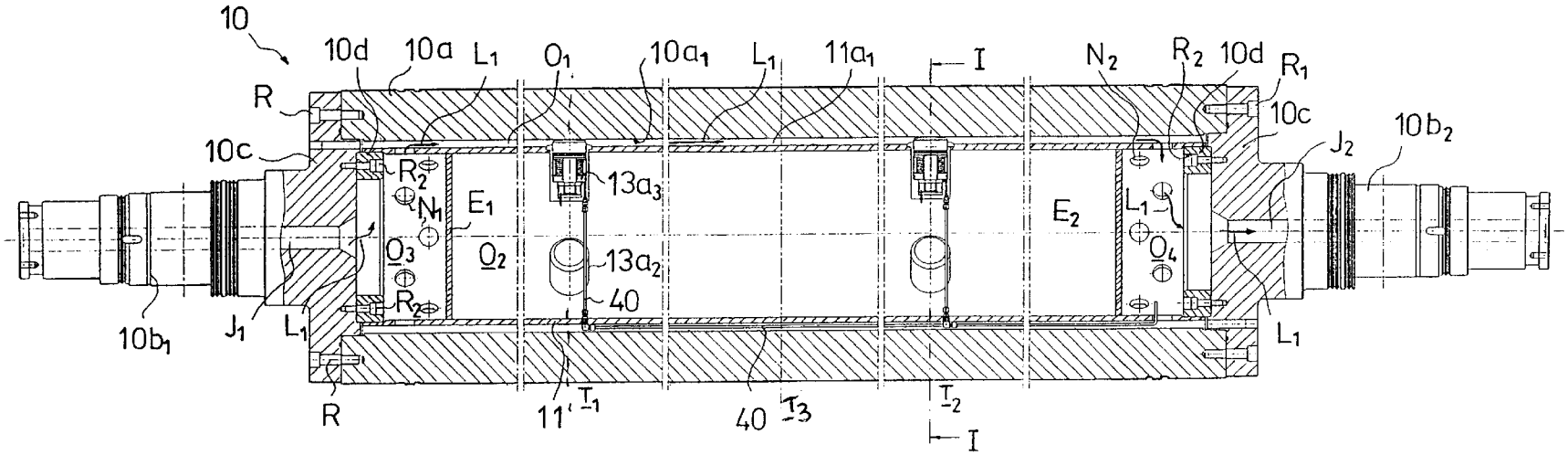
FIG. 1 is a longitudinal sectional view of a roll in accordance with the invention.

Referring to the accompanying drawings wherein the same reference numerals refer to the same or similar elements, FIG. 1 is a longitudinal sectional view of a roll 10 in accordance with the invention. The fastening between the roll 10 and an inner tube 11 installed in the interior of the roll 10 is accomplished in accordance with the invention by means of piston elements, fastening elements or fastenings $\mathbf{13}a_1$, $\mathbf{13}a_2$ and $\mathbf{13}a_3$ placed in certain fastening planes, each at a respective location in the axial direction of the inner tube 11. The fastenings 13*a* are arranged preferably at the ends and in the middle of the roll so that each fastening arrangement in a plane at a point of the length of the roll 10 comprises a three-point fastening arrangement. The fastenings $\mathbf{13}a_1$, $\mathbf{13}a_2$ and $\mathbf{13}a_3$ are arranged at a uniform angular spacing, i.e., at an angular spacing of 120°, in relation to one another on the inner tube 11 that has been installed inside the roll 10. The fastenings $\mathbf{13}a_1$, $\mathbf{13}a_2$ and $\mathbf{13}a_3$ in each fastening plane $T_1$, $T_2$ and $T_3$ fasten the inner tube 11 in the interior space O in the roll mantle 10*a* of roll 10 against the inner face $\mathbf{10}a_1$ of the roll mantle 10*a*, i.e., secure the inner tube 11 to the roll mantle 10*a*. The inner tube 11 comprises a closed inner space $O_2$ and closing plates $E_1$ and $E_2$ passing across the tube 11 and placed in the vicinity of the ends of the tube 11 (but not at the end of the tube 11 so that a portion of the roll mantle 10*a* remains outside of inner space $O_2$). At the ends of the tube 11, spaces $O_3$ and $O_4$ are thus formed on the other side of plates $E_1$ and $E_2$ and the roll mantle 10*a* includes flow passages such that water or any other heat transfer medium, preferably a cooling medium, can be passed from space $O_3$ along the roll mantle 10*a* and then into space $O_4$. More particularly, the heat transfer medium can be passed in the axial direction of roll 10 through a flow passage $J_1$ in the center of a shaft $\mathbf{10}b_1$, and shaft flange 10*c* into the space $O_3$, from space $O_3$ through the flow passages $N_1$ formed at one end of the inner tube 11 into the space $O_1$ between the outer mantle face 11*a* of the tube 11 and the inner mantle face $\mathbf{10}a_1$ of the roll 10 and then through the tubular space $O_1$ in an axial direction of the roll 10 (arrows $L_1$). The heat transfer medium is able to flow from space $O_1$ through the flow passages $N_2$ formed at the other end of the tube 11 into the space $O_4$. From space $O_4$, the medium may be passed through a central flow passage $J_2$ in the center of the shaft flange 10*c* and shaft 10*$b_2$* of the roll 10. The flow can also take place in the opposite direction, in which case the heat transfer medium, such as water, is initially passed into the other end of the roll 10 through the central flow passage $J_2$ in the shaft 10*$b_2$*.

In FIG. 1, the flow of water in connection with the roll 10 and with its inner tube 11 is indicated by the arrows $L_1$.

The roll 10 comprises shafts 10*$b_1$*, 10*$b_2$* which are attached to the roll mantle 10*a* from their shaft flanges 10*c* by means of screws R,$R_1$. An end ring 10*d* is attached to the flange 10*c* by means of screws $R_2$, and the end of the tube 11 is fitted around the end ring 10*d*. The arrangements are similar at each end of the roll 10.

Figure 2:
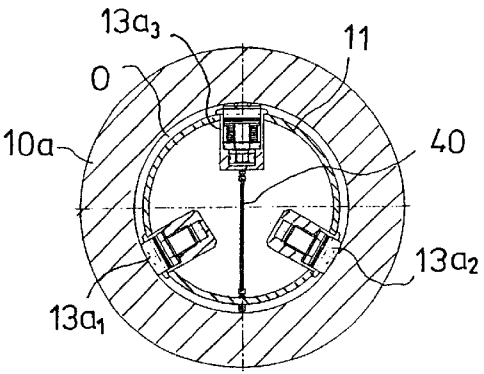
FIG. 2 is a sectional view taken along the line I—I in FIG. 1.

FIG. 2 is a sectional view taken along the line I—I in FIG. 1. As shown in FIG. 2, the fastenings 13*$a_1$*, 13*$a_2$* and 13*$a_3$* are arranged in the fastening plane $T_1$ so that they are coupled (engaged) both with the inner tube 11 and with the inner face 10*$a_1$* of the roll mantle 10*a* of the roll 10. There is an angle of about 120° between each of the fastenings 13*$a_1$*, 13*$a_2$* and 13*$a_3$*, i.e., thus, the fastening are situated with uniform angular spacing on the circumference of the inner tube 11. As shown in FIG. 2, the two fastenings 13*$a_1$* and 13*$a_2$* are identical, and the construction of the third fastening 13*$a_3$* differs from the fastenings 13*$a_1$* and 13*$a_2$*.

Figure 3B:
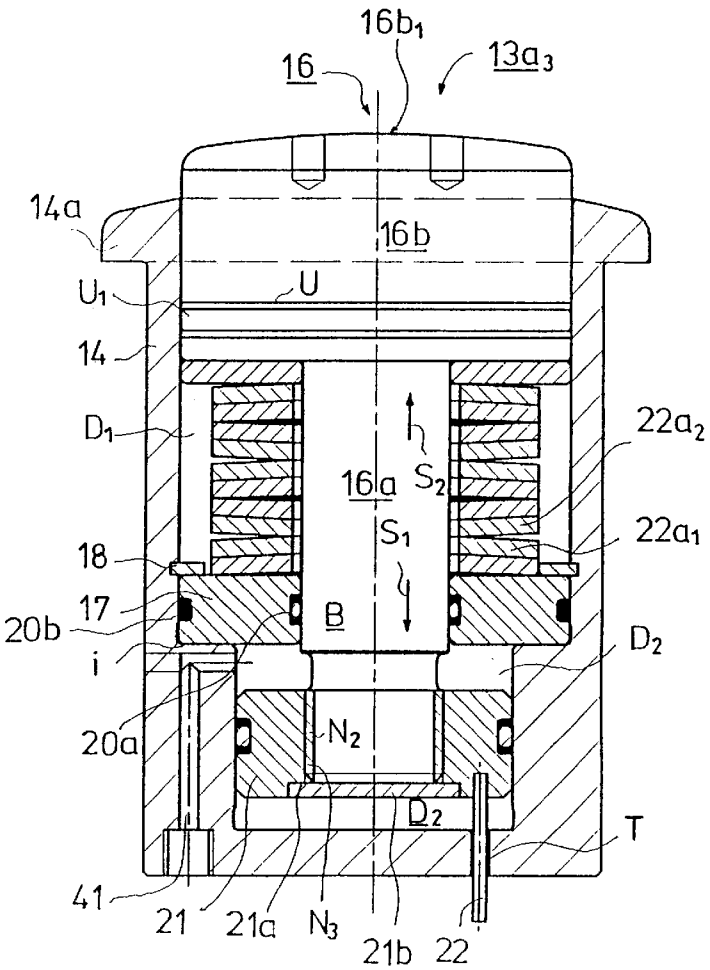
FIG. 3B shows the third fastening in the arrangement of three-point fastening, which third fastening comprises a hydraulic/spring-operated spindle.
Figure 3A:
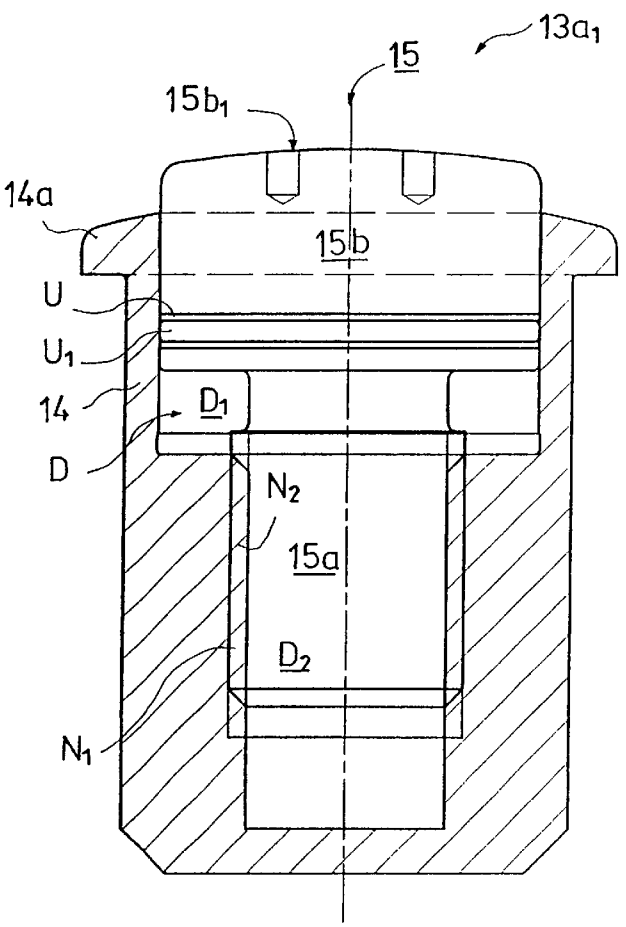
FIG. 3A is a sectional view of one of the two fastenings in the arrangement of three-point fastening.

FIG. 3A illustrates the construction of the fastening 13*$a_1$*, which is also the construction of fastening 13*$a_2$*, and is referred to herein as a fixed fastening. The fastening 13*$a_1$* comprises a sleeve 14 having an interior space D in which a screw 15 is mounted. The interior space D comprises a wider recess $D_1$ and an end bore $D_2$ (having a diameter smaller than the diameter of the wider recess $D_1$) and an inner threading $N_1$ on the end bore $D_2$. The screw 15 is brought into engagement with inner threading $N_1$ by means of an outer threading $N_2$ of an extension or spindle part 15*a* of the screw 15. In addition to the spindle part 15*a*, the screw 15 also comprises a wider backup or head part 15*b* having a curved outer face 15*$b_1$*. On the face of the backup part 15*b*, there is a groove U into which a seal ring $U_1$ has been fitted. The sleeve 14 comprises an edge widening 14*a* at the mouth of the space D. When the inner tube 11 is arranged in the space O inside the roll 10, the fastenings 13*$a_1$*, 13*$a_2$* on the inner tube 11 are placed in a certain position by rotating the screw 15 into a certain position in relation to the sleeve 14 so that a suitable degree of projection over the outer face 11*$a_1$* of the inner tube 11 is obtained for the head part 15*b* of the screw 15 from the space $D_1$ in the sleeve 14. It is only after this is done that the tube 11 is locked in the interior of the roll 10 by using the third fastening 13*$a_3$* for the locking so that when the third fastening 13*$a_3$* is released from the pressure of hydraulic fluid, it presses the head of a released spindle against the inner face 10*$a_1$* of the roll 10 by means of the spring force of its springs (discussed below with reference to FIG. 3B).

FIG. 3B illustrates the construction of the third fastening 13*$a_3$*. It is a so-called freely displaceable fastening in which the spindle part 16 of the fastening can be displaced by means of the pressure of a medium in the radial direction via remote control, i.e., from a location other than that at which the fastening 13*$a_3$* is situated. The fastening 13*$a_3$* comprises a sleeve 14 and an edge portion 14*a* in the vicinity of the inlet opening of its interior space $D_1$. Thus, the sleeve 14 comprises an interior first space $D_1$ and, at its end, a second interior space $D_2$ having a smaller diameter than first space $D_1$ and between which spaces, an inside shoulder i remains. The spindle part 16 comprises a rod 16*a* and a head part 16*b* which is connected with the rod 16*a* and operates as a backup part and is coupled with the inner face 10*$a_1$* of the roll mantle 10*a* of the roll 10. An intermediate or backup disk 17 is situated on the shoulder i and is locked by means of a cotter ring 18 so that it is stationary. The intermediate disk 17 comprises a central opening B through which the rod 16*a* of the spindle part 16 is passed freely. A seal 20*a* is arranged in the opening B in the intermediate disk 17 between the intermediate disk 17 and the rod 16*a* of the spindle part 16. A seal 20*b* is placed between the intermediate disk 17 and the inner face of the sleeve 14.

The head part 16*b* of the spindle part 16 is provided with a groove U, in which there is a seal ring $U_1$. The rod 16*a* of the spindle part 16 is provided with a threading $N_2$ at its end, which threading $N_2$ is brought into engagement with the threading $N_3$ on an inner, central bore 21*a* in a piston part 21. The end of the central bore 21*a* in the piston part is provided with an end disk 21*b*. A cotter 22 which prevents rotation is arranged in engagement with the piston part 21 and to be guided freely in an end hole T in a portion of the space $D_2$. The pressure fluid can be passed through a pipe 40 (see FIG. 1) into and from duct 41 in the sleeve 14 and further into and from the space $D_2$ between the piston part 21 and the intermediate disk 17. In this manner, when the pressure fluid is passed into the space $D_2$, a force acts upon the piston part 21 of the spindle part 16 and the spindle part 16 is pressed and moved in the direction $S_1$ against the spring force of the spring disks 22*$a_1$*, 22*$a_2$* in the spring unit 22. In this manner, the fastening 13*$a_3$* can also be installed freely into the interior of the roll 10 since it will not engage the inner surface of the roll mantle 10*a*. Once the inner tube 11 is in its desired position, the effect of the pressurized fluid is discharged from the space $D_2$ and the springs 22*$a_1$*, 22*$a_2$*, . . . in the spring unit 22 press with a force between the backup disk 17 and the head part 16*b* of the spindle part 16 so that the spindle part 16 and its head part 16*b* are displaced in the direction $S_2$. As such, the curved backup face 16*$b_1$* of the head part 16*b* is urged against the inner face 10*a*, of the roll mantle 10*$a_1$* of the roll 10.

When the inner tube 11 is installed into the interior O of the roll 10, first the fastenings 13*$a_1$*, 13*$a_2$* provided on the tube 11 in each fastening plane $T_1$, $T_2$, . . . are installed so that their screws 15 have been rotated and locked, for example, by means of a locking glue in the threading of the sleeve 14 in a certain position. Thereafter, when the tube 11 is in a precise position in the space O in the interior of the roll mantle 10*a*, the fastening 13*$a_3$* is made free from the pressure of the hydraulic fluid (i.e., the hydraulic fluid is removed from interior space $D_2$), and the springs in the spring unit 22 of the fastening 13*$a_1$* are thereby allowed to act with a force so that the head part 16*b* of the spindle part 16 of the fastening 13*$a_3$* is pressed by the spring force of the springs 22*$a_1$*, 22*$a_2$*, . . . against the inner mantle face 10*$a_1$* of the roll mantle 10*a* of the roll 10.

A pipe/hose 40 (FIG. 1) can be connected to the fluid duct 41 of the fastening 13*$a_3$*. Pipe/hose 40 can be passed from the end of the inner tube 11 on the outer face of the inner tube 11 to the fastening 13*$a_3$*. In this manner, the operation of the fastening 13*$a_3$* can be remote-controlled from the end of the roll 10 and the inner tube 11. The pressure fluid is passed from an actuator, for example from an actuator of a reversing cylinder, to the pipe 40 and further to the fastening 13*$a_3$*.

By means of the present invention, the arrangement of the tubes one inside the other becomes clearly easier, as compared with prior art procedures. The mode of fastening also permits a larger play in respect of the measures of the outer and the inner tubes. Thus, inner tubes with equal diameter can be arranged in outer tubes with different diameters. Roll-specific tailoring is no longer needed, but inner tubes of standard diameter can be used. In this way, quicker installation and shorter delivery terms can be achieved.

The examples provided above are not meant to be, exclusive. Many other variations of the present invention would be obvious to those skilled in the art, and are contemplated to be within the scope of the appended claims.

We claim:

1. A roll for a paper/board machine or finishing device, comprising a roll mantle defining an interior and having an inner face, an inner tube arranged inlaid interior of said roll mantle and having an outer face arranged at a distance from said inner face of said roll mantle such that a space is defined between said outer face of said inner tube and said inner face of said roll mantle through which a heating medium may flow, and a plurality of fastenings for coupling said inner tube to said roll mantle, at least a first one of said fastenings having a fixed radial position in which said first fastening is in engagement with said inner face of said roll mantle when said inner tube is arranged in said interior of said roll mantle, a second one of said fastenings having an adjustable radial position in which said second fastening is in engagement with said inner face of said roll mantle when said inner tube is arranged in said roll mantle;

wherein said second fastening comprises a spring unit, a piston part, and a spindle part having a head part adapted to be pressed against said inner face of said roll mantle by said spring unit, an interior space being defined between said piston part and said spindle part and receivable of a pressure medium, said spring unit being arranged such that upon removal of pressure medium from said interior space, said head part is urged outward from said inner tube.

2. The roll of claim 1, wherein said second fastening is selectively engageable with said inner face of said roll mantle when said inner tube is arranged in said interior of said roll mantle.

3. The roll of claim 1, wherein said inner tube comprises apertures at first and second ends, the roll further comprising first and second shafts arranged at first and second ends of said roll mantle, said first and second shafts each including a flow passage communicating with a space between said inner face of said roll mantle and said outer face of said inner tube via said apertures at said first and second ends of said inner tube.

4. The roll of claim 1, wherein said second fastening comprises a spindle part having a head part, and biasing means for urging said head part outward from said inner tube and into engagement with said inner face of said roll mantle.

5. The roll of claim 4, wherein said second one of said fastenings further comprises an interior space for receiving pressure fluid defined adjacent said spindle part, said biasing means being arranged such that upon removal of pressure fluid from said interior space, said head part is urged outward from said inner tube.

6. The roll of claim 1, wherein said at least a first fastening comprises first and third identical fastenings arranged at a common axial position, said first and third fastenings comprising a sleeve and a screw arranged in said sleeve and having an outer face adapted to be pressed against said inner face of said roll mantle, said screw being rotatable relative to said sleeve to provide adjustable extension of said screw from said sleeve.

7. The roll of claim 6, wherein said screw is locked in said sleeve after being rotated to a desired radial position.

8. The roll of claim 6, wherein said second fastening is arranged in the same axial position as said first and third fastenings.

9. The roll of claim 1, wherein said second fastening further comprises a sleeve defining a first interior space and a second interior space having a diameter smaller than a diameter of said first interior space and having an edge portion in the vicinity of an inlet opening of said first interior space, said sleeve defining an inside shoulder between said first and second interior spaces, said spring unit being arranged in said first interior space, said piston part being arranged in said second interior space, and said spindle part extending into said first and second interior spaces.

10. The roll of claim 1, wherein said second fastening further comprises a sleeve defining a shoulder, said spring unit, said piston part and said spindle part being arranged in said sleeve, and an intermediate disk arranged on said shoulder and a cotter ring for locking said disk against said shoulder, said spindle part having a rod connected to said head part, said disk including a central opening through which said rod of said spindle part passes.

11. The roll of claim 10, wherein said piston part includes an inner bore having threading and said rod includes a threading in engagement with said threading of said piston part, said second fastening further comprising an end disk arranged at an end of said inner bore of said piston part, and a cotter coupled to said piston part for preventing rotation of said piston part, said cotter being guided in a hole in said sleeve of said second fastening, said sleeve of said second fastening including a duct for allowing passage of pressure fluid into and from said interior space in said second fastening.

12. The roll of claim 10, wherein said spring unit comprises springs arranged around said rod of said spindle part between said head part of said spindle part and said disk.

13. The roll of claim 1, said first fastening comprises a sleeve having an interior and a screw arranged in said interior of said sleeve and having an outer face adapted to be pressed against said inner face of said roll mantle, said screw having a spindle part having a threaded outer surface and a backup part wider than said spindle part, said interior of said sleeve defining a wide recess and an end bore having a threading, said spindle part of said screw threadingly engaging with said threading of said end bore of said sleeve, said backup part including a curved outer face adapted to be pressed against said inner face of said roll mantle upon rotation of said screw relative to said sleeve.

14. The roll of claim 1, wherein said plurality of fastenings comprise three sets of three fastenings arranged at a first end of said inner tube, a second end of said inner tube and in a middle of said inner tube, said at least a first fastening in each of said sets of fastenings comprising first and third fastenings and each of said sets of fastenings including said second fastening.

* * * * *